US010926554B2

(12) United States Patent
Ohnishi

(10) Patent No.: US 10,926,554 B2
(45) Date of Patent: Feb. 23, 2021

(54) PRINTING APPARATUS AND PRINT METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/529,735

(22) Filed: Aug. 1, 2019

(65) Prior Publication Data

US 2020/0070544 A1 Mar. 5, 2020

(30) Foreign Application Priority Data

Aug. 31, 2018 (JP) ..... JP2018-163002

(51) Int. Cl.
*B41J 11/00* (2006.01)
*B41J 2/21* (2006.01)

(52) U.S. Cl.
CPC ..... *B41J 11/002* (2013.01); *B41J 2/2103* (2013.01)

(58) Field of Classification Search
CPC ..... B41J 2/2103; B41J 11/002
See application file for complete search history.

(56) References Cited

U.S. PATENT DOCUMENTS 8,371,685 B2 * 2/2013 Kusunoki ..... B41J 2/04581 347/17
8,888,270 B2 * 11/2014 Kachi ..... B41J 11/002 347/102
9,022,545 B2 * 5/2015 Kondo ..... B41J 11/002 347/102

FOREIGN PATENT DOCUMENTS

JP 2016135577 7/2016
WO 2017135425 8/2017

* cited by examiner

*Primary Examiner* — Lamson D Nguyen
(74) *Attorney, Agent, or Firm* — JCIPRNET

(57) ABSTRACT

A printing apparatus and a printing method are provided. The printing apparatus that performs a printing through an inkjet method includes: a conveyor driver which is a medium conveyor device; a plurality of ink ejection portions arranged side by side along a conveyance direction; and a plurality of ultraviolet light sources which are a plurality of fixing devices. Each of the ink ejection portions includes a plurality of inkjet heads arranged side by side along the conveyance direction. Each of the plurality of ultraviolet light sources is disposed on a downstream side in the conveyance direction with respect to any one of the ink ejection portions. After the medium passes a position facing the plurality of inkjet heads in one of the ink ejection portions, the ink ejected by the one of the ink ejection portions is fixed to the medium.

14 Claims, 7 Drawing Sheets

| Usage data | Three-color separation | | Four-color separation | | Seven-color separations (without pale color) | | | |
|---|---|---|---|---|---|---|---|---|
| | Head arrangement | Separation data volume | Head arrangement | Separation data volume | Head arrangement | | Separation data volume | |
| | LP-1 | | LP-2 | | LP-3 | LP-4 | YMCK | RGB |
| **Data A** | 220 | Y; 100<br>M; 80<br>C; 40 | 140 | Y; 60<br>M; 40<br>C; 0<br>K; 40 | 100 | 40 | Y; 20<br>M; 0<br>C; 0<br>K; 40 | R; 40<br>G; 0<br>B; 0 |
| **Data B** | 180 | Y; 100<br>M; 60<br>C; 20 | 140 | Y; 80<br>M; 40<br>C; 0<br>K; 20 | 100 | 40 | Y; 40<br>M; 0<br>C; 0<br>K; 20 | R; 40<br>G; 0<br>B; 0 |
| **Data C** | 150 | Y; 100<br>M; 50<br>C; 0 | 150 | Y ; 100<br>M; 50<br>C; 0<br>K; 0 | 100 | 50 | Y; 50<br>M; 0<br>C; 0<br>K; 0 | R; 50<br>G; 0<br>B; 0 |
| **Data D** | 180 | Y; 80<br>M; 60<br>C; 40 | 100 | Y; 40<br>M; 20<br>C; 0<br>K; 40 | 80 | 40 | Y; 20<br>M; 0<br>C; 0<br>K; 40 | R; 20<br>G; 0<br>B; 0 |
| **Data E** | 200 | Y; 80<br>M;100<br>C; 20 | 160 | Y; 60<br>M; 80<br>C; 0<br>K; 20 | 100 | 60 | Y; 0<br>M; 20<br>C; 0<br>K; 20 | R; 60<br>G; 0<br>B; 0 |

| Usage data | Seven-color separations (with pale color) | | | | | | | |
|---|---|---|---|---|---|---|---|---|
| | Head arrangement | | Separation data | | | | | |
| | | | Primary color | | Secondary color | | Tertiary color | |
| | Lp-5 | Lp-6 | YMC | Ly,Lm,Lc | RGB | Lr,Lg,Lb | K | Lk |
| **Data A** | 180 | 80 | Y; 20<br>M; 0<br>C; 0 | Ly; 0<br>Lm; 0<br>Lc; 0 | R; 0<br>G; 0<br>B; 0 | Lr; 80<br>Lg; 0<br>Lb; 0 | K; 0 | Lk;80 |
| **Data B** | 160 | 80 | Y; 40<br>M; 0<br>C; 0 | Ly; 0<br>Lm; 0<br>Lc; 0 | R; 0<br>G; 0<br>B; 0 | Lr; 80<br>Lg; 0<br>Lb; 0 | K; 0 | Lk;40 |
| **Data C** | 150 | 100 | Y; 50<br>M; 0<br>C; 0 | Ly; 0<br>Lm; 0<br>Lc; 0 | R; 0<br>G; 0<br>B; 0 | Lr; 100<br>Lg; 0<br>Lb; 0 | K; 0 | Lk; 0 |
| **Data D** | 140 | 80 | Y; 20<br>M; 0<br>C; 0 | Ly; 0<br>Lm; 0<br>Lc; 0 | R; 0<br>G; 0<br>B; 0 | Lr; 40<br>Lg; 0<br>Lb; 0 | K; 0 | Lk; 80 |
| **Data E** | 100 | 40 | Y; 0<br>M; 0<br>C; 0 | Ly; 0<br>Lm; 40<br>Lc; 0 | R; 0<br>G; 0<br>B; 0 | Lr; 40<br>Lg; 0<br>Lb; 0 | K; 0 | Lk; 20 |

FIG. 7

PRINTING APPARATUS AND PRINT METHOD

CROSS REFERENCE TO RELATED APPLICATIONS

This application claims the priority benefit of Japanese Patent Application No. 2018-163002, filed on Aug. 31, 2018. The entirety of the above-mentioned patent application is hereby incorporated by reference herein and made a part of this specification.

TECHNICAL FIELD

The present disclosure relates to a printing apparatus and a print method.

DESCRIPTION OF THE BACKGROUND ART

Conventionally, an inkjet printer, which is a printing apparatus that performs printing through an inkjet method, has been widely used. In recent years, as a method for performing high-definition printing with an inkjet printer, consideration is being made to perform printing through a seven-color separation system, which is a method of printing using inks of seven or more colors including red (R color), green (G color), and blue (B color) inks in addition to yellow (Y color), magenta (M color), cyan (C color), and black (K color) inks (see e.g., Japanese Unexamined Patent Publication No. 2016-135577, Patent Literature 1). Furthermore, conventionally, in applications where high speed printing is carried out and in applications of textile printers that perform printing on a fabric medium, practical applications of line printers, which are inkjet printers having a line-type configuration, are being advanced. In a line printer, for example, a wide width, high-resolution inkjet head having a length corresponding to the width (printer width) of a printing region is used to eject ink from the inkjet head while conveying a medium to be printed, so that printing is performed in a one-pass method in which the inkjet head passes above each position of the medium only once.

Patent Literature 1: Japanese Unexamined Patent Publication No. 2016-135577.

SUMMARY

Even when performing printing with a line printer, a higher-definition printing can be performed by performing printing using the seven-color separation system. However, in the configuration of the line printer, usually, one ink fixing devices is provided for one inkjet head (inkjet head for one color), and arranged side by side in the conveyance direction. In this case, if the seven-color separation system is simply adopted, a great number of inkjet heads and fixing devices are arranged side by side along the conveyance direction of the medium, which may make the problems of increase in the size of the apparatus and increase in cost significant. Furthermore, when a higher quality printing is to be performed, consideration may be made to also use a pale ink (light ink) in which the color strength is relatively pale as an ink of a color of at least one part. In such a case, the problems of increase in the size of the apparatus and increase in cost are assumed to become more significant. Therefore, conventionally, a configuration capable of more appropriately preventing problems such as an increase in size has been desired as a configuration of a line printer or the like.

The present disclosure thus provides a printing apparatus and a print method capable of overcoming such problem.

When color printing is performed in an inkjet printer, various colors are usually expressed by the principle of the subtractive color mixing method by forming ink dots of a plurality of colors on a medium. However, in this case, if inks of different colors in a liquid state come into contact on the medium, ink smearing may occur (inter-color smearing) and the printing quality may degrade. Therefore, when printing is performed with a line printer, as described above, usually, ink fixing devices (e.g., heater) is disposed between each inkjet head, and the ink ejected on the medium by each inkjet head is fixed to the medium before the next ink is ejected by the next inkjet head. In this case, if a large number of inkjet heads are used as in the seven-color separation system, the number of fixing devices to use also increases according to the number of inkjet heads. This, as a result, leads to increase in size of the apparatus and increase in cost.

On the other hand, the inventor of the present application focused on a fact that in a case where printing is performed by the seven-color separation system, in principle, there exists a combination of colors that are not ejected to the same position (ejection position) on the medium as the combination of colors that need to be mixed on the medium is limited. More specifically, for example, in a case where inks of only four colors of Y, M, C, and K are used, the ink of each color of Y, M, and C, which is a chromatic color, needs to be ejected so that inks of two or more colors overlap at the same position on the medium in all combinations to represent various colors. However, when inks of seven colors of Y, M, C, and K and R, G, and B are used, an ink of R, G, and B, which is a secondary color combining two colors of Y, M, and C which is a primary color, exists, and hence in principle, the ink of each color of Y, M, and C does not need to be ejected to the same position on the medium. Furthermore, in this case, each color of the primary color is a color combining two colors of the secondary color. Thus, in principle, the inks of each color of R, G, and B also do not need to be ejected to the same position on the medium.

In this case, the occurrence of inter-color smearing and the like can be appropriately suppressed for the inks of each color of Y, M, C or R, G, B without necessarily fixing every ink of one color on the medium. Therefore, the inventor of the present application considered to, rather than individually arranging the fixing devices for the plurality of inkjet heads for the inks of the plurality of colors, collectively arrange one fixing devices on the downstream side of the plurality of inkjet heads (downstream side in the conveyance direction of the medium). Even with such a configuration, the occurrence of inter-color smearing, and the like can be appropriately prevented by arranging the fixing devices for every group of colors that do not eject ink to the same position on the medium. Further, in this case, the increase in size of the apparatus and the increase in cost can be appropriately suppressed by reducing the number of fixing devices to use.

Furthermore, the inventor of the present application found, through further intensive research, the features necessary for obtaining such effects and contrived the present disclosure. In order to solve the above-described problems, the present disclosure relates to a printing apparatus that performs a printing through an inkjet method. The printing apparatus includes: a medium conveyor device that conveys a medium to be printed in a conveyance direction set in advance; a plurality of ink ejection portions, arranged side by side along the conveyance direction; and a plurality of fixing devices that fix the ink to the medium. Each of the ink ejection portions includes: a plurality of inkjet heads that eject inks of different colors. The plurality of inkjet heads in each of the ink ejection portions are arranged side by side along the conveyance direction. Each of the plurality of fixing devices is disposed on a downstream side in the conveyance direction with respect to any one of the ink ejection portions, and after the medium passes a position facing the plurality of inkjet heads in one of the ink ejection portions, the ink ejected by the one of the ink ejection portion is fixed to the medium.

With such a configuration, for example, the increase in size of the apparatus and the increase in cost can be appropriately suppressed in the configuration of a line printer or the like. Therefore, with such a configuration, for example, printing using a large number of inkjet heads such as a seven-color separation system can be more appropriately performed in the line printer and the like. Furthermore, high-definition printing can be more appropriately performed in a line printer or the like.

Furthermore, in this configuration, with regards to the fixing devices, fixing the ink on the medium after the medium passes through the position facing the plurality of inkjet heads in one ink ejection portion means, for example, executing an operation for fixing the ink after each part of the medium has passed through the position facing the plurality of inkjet heads in one ink ejection portion. In this configuration, it is conceivable to use, for example, an ink that fixes to the medium by evaporation of a solvent, as the ink. In this case, for example, it is conceivable to use a heater that heats the ink as the fixing devices. Then, in this case, for example, the fixing devices does not perform heating in a range in which the plurality of inkjet heads are arranged side by side in the ink ejection portion, and heats the ink on the downstream side of the ink ejection portion to fix the ink on the medium.

Furthermore, in this configuration, for example, an instant-drying type ink can be suitably used as the ink. The instant-drying type ink is, for example, an ink that generates heat by absorbing a predetermined energy ray. In this case, each of the plurality of fixing devices heats the ink on the medium by irradiating the ink on the medium with energy rays. According to this configuration, for example, the ink can be appropriately dried in a short time even when the amount of ink existing in a liquid state on the medium is large.

Moreover, in this configuration, for example, each inkjet head in each ink ejection portion ejects ink to an ejection position set according to the resolution of printing. In this case, it is conceivable to select, for example, an inkjet head of a combination of colors that do not need to be mixed on the medium as the plurality of inkjet heads included in one ink ejection portion. In this case, the plurality of inkjet heads in one ink ejection portion, for example, eject ink so that ink dots of different colors do not overlap at the same ejection position. With this configuration, for example, the occurrence of inter-color smearing and the like can be appropriately prevented.

Furthermore, more specifically, for example, consideration is made to use as the plurality of ink ejection portions, at least a first ink ejection portion including the plurality of inkjet heads, each of which ejecting ink of a primary color; and a second ink ejection portion including the plurality of inkjet heads, each of which ejecting ink of a secondary color. In this case, the primary color is, for example, a basic color that in principle allows representation of colors in a subtractive color mixing method by color mixing. The secondary color is, for example, a color obtained in principle by mixing a plurality of the primary colors. Furthermore, more specifically, in this case, consideration is made to use, as the plurality of inkjet heads in the first ink ejection portion, for example, the plurality of inkjet heads each ejecting ink of each color of yellow (Y color), magenta (M color) and cyan (C color). In addition, consideration is made to use as the plurality of inkjet heads in the second ink ejection portion, for example, the plurality of inkjet heads each ejecting ink of each color of red (R color), green (G color), and blue (B color). With this configuration, for example, the increase in size of the apparatus and the increase in cost can be more appropriately suppressed in the configuration of a line printer or the like.

Furthermore, when printing is performed in a line printer or the like, the ink dots of the respective colors overlap in order, and thus it can be considered that the influence on the graininess is greater for the ink ejected later. Therefore, in this case, the ink of a color that makes the graininess more noticeable is preferably ejected to the medium before the ink of other colors. Furthermore, in this regard, when using the inks of primary and secondary colors, the graininess is usually more noticeable with the ink of the secondary color than the ink of the primary color. Thus, in the case the first and second ink ejection portions are used as described above, the second ink ejection portion is preferably disposed on the upstream side of the first ink ejection portion in the conveyance direction. According to such a configuration, for example, the graininess can be more appropriately prevented from being noticeable in the printing result.

When printing is performed by the seven-color separation system, it is conceivable to further use an ink of black color (K color), which is a tertiary color, in addition to the inks of the primary and secondary colors. In this case, it is considered that the influence on the graininess is particularly large for the black color ink. Therefore, in this case, the ink ejection portion including the inkjet head for black color is preferably disposed at least at a position other than the most downstream in the conveyance direction. More specifically, in this case, one of the plurality of ink ejection portions includes an inkjet head that ejects black color ink. The ink ejection portion including an inkjet head for ejecting black color ink is preferably disposed on the upstream side of any other ink ejection portions in the conveyance direction. According to such a configuration, for example, the graininess can be more appropriately prevented from being noticeable in the printing result.

In order to suppress the graininess, it is conceivable to use for example, a dark ink in which the color strength is relatively dark and a pale ink (light ink) in which the color strength is relatively pale as an ink of at least one of the colors. Furthermore, in this case, the dark ink and the pale ink of the same color become, in principle, the ink having a possibility of being ejected to the same ejection position. Therefore, in this case, it is preferable to make the ink ejection portion including the inkjet head that ejects the dark ink and the ink ejection portion including the inkjet head that ejects the pale ink for the color using the dark ink and the pale ink different from each other. According to such a configuration, for example, printing using pale ink can be more appropriately performed.

Further, in this case, when the dark ink and the pale ink of the same color are compared, the dark ink has a greater influence on the graininess. Therefore, the ink ejection portion including the inkjet head that ejects the dark ink is preferably disposed on an upstream side of the ink ejection portion including the inkjet head that ejects the pale ink of the same color in the conveyance direction. According to such a configuration, for example, the graininess can be more appropriately prevented from being noticeable in the printing result.

Use of a print method having the features similar to above, and the like can be considered for the configuration of the present disclosure. In this case as well, for example, effects similar to the above can be obtained.

According to the present disclosure, for example, the increase in size of the apparatus and the increase in cost can be appropriately suppressed in the configuration of a line printer or the like.

BRIEF DESCRIPTION OF THE DRAWINGS

FIGS. 1A and 1B are a side view and a top view of the printing apparatus 10, respectively.

FIGS. 2A and 2B are a side view and a top view showing an example of the configuration of the plurality of head portions 12 in the present modified example, respectively.

FIGS. 3A and 3B are a side view and a top view showing an example of the configuration of the plurality of head portions 12 in the present modified example, respectively.

FIGS. 4A and 4B are side views respectively showing the configuration of such a modified example.

FIG. 7 is a view showing an example of the relationship between the arrangement of inkjet heads and the color of ink.

DESCRIPTION OF EMBODIMENTS

Figure 1A:
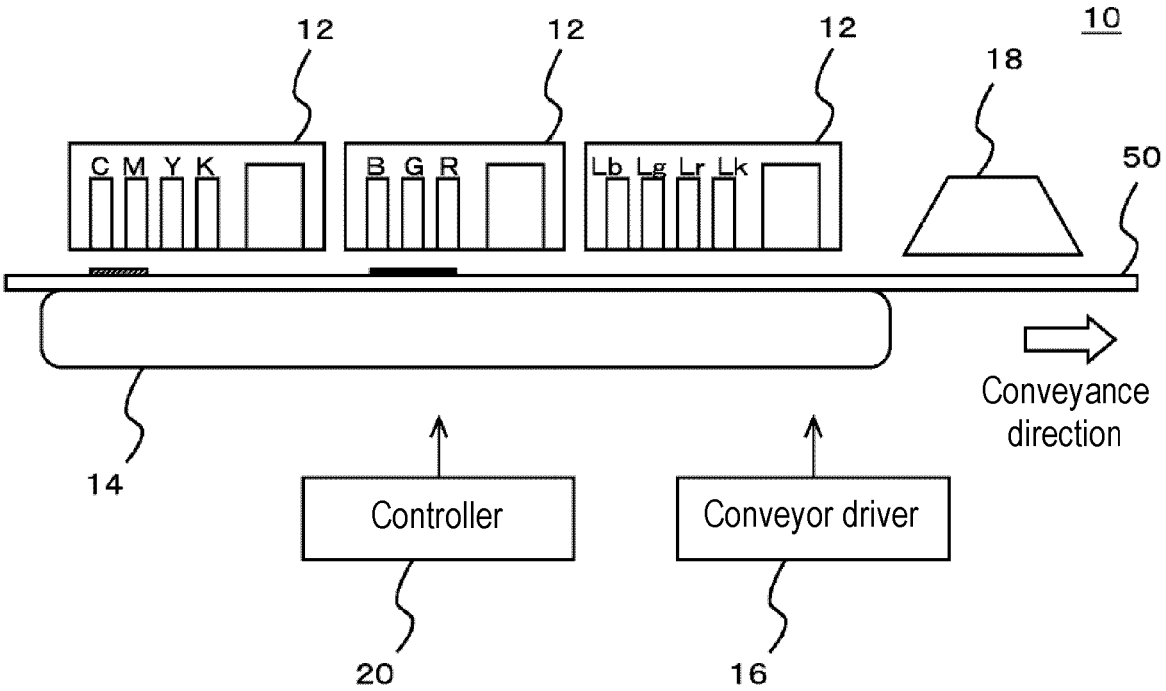
FIGS. 1A and 1B are views showing an example of a configuration of a printing apparatus 10 according to one embodiment of the present disclosure.
Figure 1B:
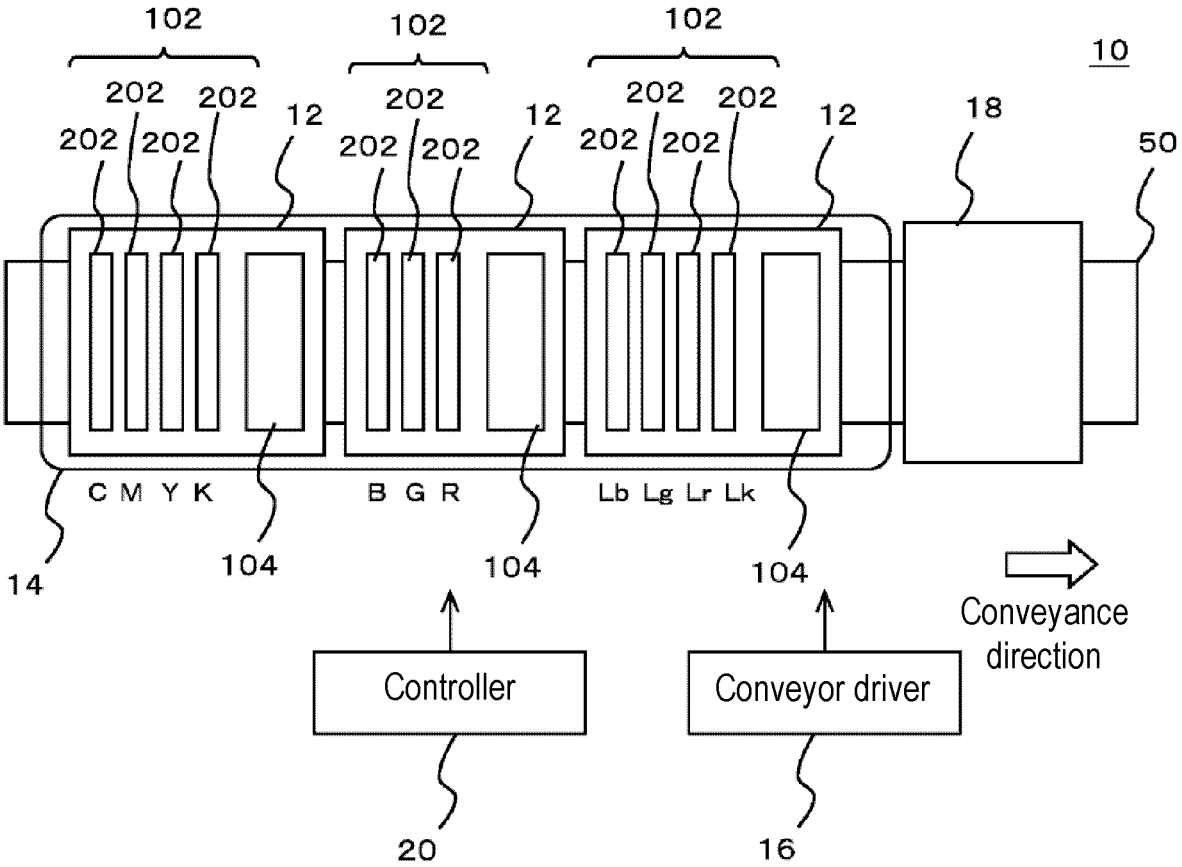

Hereinafter, an embodiment according to the present disclosure will be described with reference to the drawings. FIGS. 1A and 1B show one example of a configuration of a printing apparatus 10 according to one embodiment of the present disclosure. FIGS. 1A and 1B are a side view and a top view of the printing apparatus 10, respectively. Note that, other than the points described below, the printing apparatus 10 may have features identical or similar to known inkjet printers. Other than the illustrated configuration, the printing apparatus 10 may further include various configurations identical or similar to known inkjet printers.

First, ink used in the printing apparatus 10 of the present example will be described. In the present example, the printing apparatus 10 performs the seven-color separation system using inks of seven colors of cyan (C color), magenta (M color), yellow (Y color), black (K color), blue (B color), green (G color), and red (R color). In this case, each color of C, M, and Y can be considered as an example of a primary color. The primary color is, for example, a basic color that, in principle, allows representation of colors in a subtractive color mixing method by color mixing. Furthermore, each color of R, G, and B can be considered as an example of a secondary color. The secondary color is, for example, a color obtained in principle by mixing a plurality of the primary colors. The K color can be considered as an example of a tertiary color. The tertiary color is, for example, a color obtained in principle by mixing all primary colors or mixing all secondary colors. Furthermore, in the case of using the seven colors as described above, each of the secondary colors can be considered as, for example, an intermediate color of two primary colors. In this case, the seven-color separation system using seven colors as described above can also be considered as a seven-color separation system (complete seven-color separation system) that is complete in principle.

In addition, when printing is performed with the seven-color separation system, for example, R color obtained by mixing color of Y color and M color can be directly represented (1Y+1M=1R) by using an ink of each color of R, G, and B which is a secondary color, in addition to each color of Y, M, and C which is a primary color, thus enhancing color rendering property. However, in this case, the number of ink dots (number of pixels) formed at the time of printing is reduced, and the dots of secondary colors dark in color are formed, whereby particles of the ink dots stand out and the pixels may be visually recognized as being rough. Furthermore, as a result, the graininess may be increased and the print quality (image quality) may be felt as degraded. On the other hand, in order to suppress the graininess, consideration is made to use a dark ink in which the color strength is relatively dark and a pale ink (light ink) in which the color strength is relatively pale for at least some of the colors instead of simply performing printing with the seven-color separation system. More specifically, in the present example, pale ink is used for each color of R, G, B, and K.

Furthermore, in the present example, an evaporation-drying type ink that fixes to the medium 50 to be printed by evaporation of the solvent is used as the ink of each color. In this case, the ink of each color described above contains, for example, a coloring material of each color and a solvent. Furthermore, in this case, it is conceivable to use an ink containing the solvent by 50% or more in weight ratio. Moreover, in the present example, an instant-drying type ink is used as the evaporation-drying type ink of each color. The instant-drying type ink is, for example, an ink that generates heat by absorbing a predetermined energy ray. Furthermore, more specifically, in the present example, an instant-drying type ink which generates heat by absorbing ultraviolet light is used as an ink of each color. In this case, for example, it is conceivable to use an ink that further contains an ultraviolet light absorbing agent or the like that generates heat by absorbing ultraviolet light. Further, for example, when a component of the ink such as a coloring material absorbs the ultraviolet light and generates heat, it can be assumed that the component also serves as an ultraviolet absorbing agent. Moreover, as the instant-drying type ink, for example, it is conceivable to use an ink identical or similar to the ink disclosed in WO 2017/135425.

Next, a configuration of the printing apparatus 10 that performs printing using the ink described above will be described. In the present example, the printing apparatus 10 is a line-type inkjet printer (line printer) that performs printing through an inkjet method while fixing the position of the inkjet head and conveying the medium 50. In this case, the line-type inkjet printer refers to, for example, that in which an inkjet head for each color used for printing is lined in a straight line along the conveyance direction (media moving direction, hereinafter simply referred to as the conveyance direction) of the medium 50 set in advance in the printing apparatus 10. Moreover, in the present example, the inkjet head for each color used for printing refers to all the inkjet heads used for printing.

Furthermore, in the present example, the printing apparatus 10 includes a plurality of head portions 12, a platen 14, a conveyor driver 16, an infrared heater 18, and a controller 20. The head portion 12 is a part including at least one inkjet head and an ink fixing devices. The head portion 12 can be considered as, for example, a configuration that becomes a unit of performing ejection of ink to the medium 50. Furthermore, in the present example, the plurality of head portions 12 are arranged side by side along the conveyance direction. In addition, each head portion 12 ejects the ink to the medium 50 by the inkjet head, and thereafter irradiates the ink on the medium 50 with ultraviolet light, so that the ink ejected to the medium 50 in each head portion 12 is fixed to the medium 50 before each part of the medium 50 reaches the position of the next head portion 12. A more specific configuration of each head portion 12 will be described in detail later.

The platen 14 is a table-shaped member that supports the medium 50 on the upper surface at a position facing the plurality of head portions 12. The conveyor driver 16 is an example of a medium conveyor device that conveys the medium 50, and conveys the medium 50 in the conveyance direction using, for example, a roller (not shown) and the like. In the present example, the conveyor driver 16 faces each of the plurality of head portions 12 in order at each position of the medium 50 by conveying the medium 50 at a constant speed. Furthermore, in this case, the conveyor driver 16 continuously conveys the medium 50 at a constant speed without stopping the conveyance even, for example, at the timing of ejecting the ink from each inkjet head in the head portion 12, so that each inkjet head in each head portion 12 is caused to eject ink to each part of the medium 50.

The infrared heater 18 is a heater (after-heater) that heats the medium 50 on the downstream side of the plurality of head portions 12 in the conveyance direction. The ink on the medium 50 can be more reliably dried by using the infrared heater 18. Furthermore, as described above, in the present example, an instant-drying type ink which generates heat by irradiation of ultraviolet light is used as the ink. Then, in each of the head portions 12, the ink is directly heated by irradiating the ultraviolet light. On the other hand, the infrared heater 18 indirectly heats the ink on the medium 50 through a different method from the head portion 12 by heating the entire medium 50. When configured in such a manner, the ink can be dried through a plurality of methods in the printing apparatus 10. Furthermore, for example, the ink thus can be more reliably dried.

The controller 20 is, for example, a CPU of the printing apparatus 10, and controls the operation of each portion of the printing apparatus 10 to cause the printing apparatus 10 to execute a printing operation. Furthermore, in this case, the controller 20 controls the printing operation by, for example, controlling the timing at which each inkjet head in each head portion 12 ejects ink according to the image to be printed.

Subsequently, a more specific configuration of each head portion 12 will be described. In the present example, each of the head portions 12 includes an ink ejection portion 102 and an ultraviolet light source 104, as indicated by reference numerals in FIG. 1B. The ink ejection portion 102 is a part configured by an inkjet head 202 in the head portion 12. Furthermore, in the present example, the ink ejection portion 102 in each head portion 12 includes a plurality of inkjet heads 202 that eject inks of different colors from each other.

More specifically, in the case of the configuration shown in FIGS. 1A and 1B, the head portion 12 on the most upstream side in the conveyance direction includes a plurality of inkjet heads 202 for each color of C color, M color, Y color, and K color, as indicated by alphabetic symbols in the figure. Furthermore, as shown in the figure, the inkjet heads 202 are arranged side by side in the above order along the conveyance direction. Moreover, in this case, the ink of K color is not a pale ink but an ink (dark ink) showing a black color with a standard color strength. In the present example, the inks of each color of C, M, and Y are examples of the inks of the primary colors. Thus, the ink ejection portion 102 can also be considered as an ink ejection portion 102 for primary colors. Furthermore, the ink ejection portion 102 including the inkjet head 202 for ink of each color of C, M, and Y is an example of a first ink ejection portion. Moreover, the ink ejection portion 102 including the inkjet head 202 for the ink of each color of C, M, Y, and K can also be considered as, for example, the ink ejection portion 102 for primary and tertiary colors.

The head portion 12 second from the upstream side in the conveyance direction includes a plurality of inkjet heads 202 for each color of blue (B color), green (G color), and red (R color) as indicated by alphabetic symbols in the figure. Furthermore, as shown in the figure, the inkjet heads 202 are arranged side by side in the above order along the conveyance direction. Moreover, in this case, the ink of each color of B, G, and R is not a pale ink, but an ink (dark ink) showing each color of B, G, and R with a standard color strength. In the present example, the ink of each color of B, G, and R is an example of the ink of the secondary color. Thus, the ink ejection portion 102 can also be considered as an ink ejection portion 102 for secondary colors. Furthermore, the ink ejection portion 102 including the inkjet head 202 for ink of each color of B, G, and R is an example of a second ink ejection portion.

The head portion 12 at the most downstream in the conveyance direction, which is the third from the upstream side in the conveyance direction, includes a plurality of inkjet heads 202 for each color of light blue (Lb color), light green (Lg color), light red (Lr color), and light black (Lk color), as indicated by alphabetic symbols in the figure. In this case, inks of each color of Lb, Lg, Lr, and Lk are inks for pale colors of each color of B, G, R, and K, and show each color at a thin concentration as compared with each color of B, G, R, and K described above. Furthermore, in this case, the head portion 12 can be considered as the head portion 12 or the like including only the inkjet head 202 for pale ink in which the color strength is relatively light.

In each of the head portions 12, the ultraviolet light source 104 is an example of a fixing devices that fixes the ink to the medium 50, and is disposed on the downstream side of the ink ejection portion 102 in each of the head portions 12 to irradiate the ink ejected onto the medium 50 by the ink ejection portion 102 in the same head portion 12 with the ultraviolet light, which is an example of an energy ray. Thus, the ultraviolet light source 104 directly heats the ink on the medium 50 to remove at least a part of the solvent in the ink. The ultraviolet light source 104 can also be considered as, for example, a heater that heats the ink. The ultraviolet light source 104 can also be considered as a dryer (instant-dryer) used in the instant-drying method. More specifically, in the present example, the ultraviolet light source 104 volatilizes and removes at least a part of the solvent in the ink to increase the viscosity of the ink to at least a viscosity at which no smearing occurs on the medium 50. In this case, when referring to no smearing occurring on the medium 50, this means, for example, that when ink is further ejected onto the medium 50 by the head portion 12 on the downstream side, smearing (inter-color smearing) substantially does not occur even if brought into contact with the ink (ink in liquid state). Furthermore, when referring to smearing substantially not occurring, this means, for example, that the smearing in question does not occur according to the quality demanded on printing. More specifically, in the present example, the ultraviolet light source 104 irradiates the ink on the medium 50 with ultraviolet light to dry the ink at least to an extent the ink of the next color can be superimposed thereon in the configuration of the line printer. For example, ultraviolet LED (UV LED) that generates an ultraviolet light can be suitably used for the ultraviolet light source 104. In this case, the UV LED that generates the ultraviolet light of a wavelength that matches the wavelength range to be absorbed by the ink is preferably used.

Here, when the arrangement of the ink ejection portions 102 in the entire printing apparatus 10 is considered, the plurality of ink ejection portions 102 are arranged side by side along the conveyance direction. Furthermore, in this case, the plurality of inkjet heads 202 in each of the ink ejection portions 102 are arranged side by side along the conveyance direction. Moreover, the ultraviolet light source 104 in each of the plurality of ink ejection portions 102 is disposed between the ink ejection portions 102 and on a further downstream side of the ink ejection portion 102 on the most downstream side in the conveyance direction. With such a configuration, each ultraviolet light source 104 is disposed on the downstream side in the conveyance direction with respect to any one of the ink ejection portions 102, whereby the ink ejected by the ink ejection portion 102 is fixed on the medium 50 after the medium 50 has passed through the position facing the plurality of inkjet heads 202 in one ink ejection portion 102. In this case, when the medium 50 passes the position facing the plurality of inkjet heads 202, this means that each part of the medium 50 passes the position. Furthermore, fixing the ink on the medium 50 after the medium 50 passes through the position facing the plurality of inkjet heads 202 in one ink ejection portion 102 means, for example, executing an operation for fixing the ink after each part of the medium 50 has passed through the position facing the plurality of inkjet heads 202 in one ink ejection portion 102. According to such a configuration, for example, as described above, the ink ejected to the medium 50 in each head portion 12 can be appropriately fixed to the medium 50 before each part of the medium 50 reaches the position of the next head portion 12.

Furthermore, as can be seen from the configuration shown in the figure, in the present example, the ultraviolet light source 104 does not perform heating in a range in which the plurality of inkjet heads 202 of the ink ejection portion 102 in the same head portion 12 are disposed, and collectively performs heating on the ink ejected from the plurality of inkjet heads 202 to the medium 50 on the downstream side of the ink ejection portion 102. In this case, not performing heating in a range in which the plurality of inkjet heads 202 are arranged side by side means not performing intentional heating between the inkjet heads 202 in one ink ejection portion 102 or the like. In addition, "not performing intentional heating" means, for example, not performing heating in the relevant region in design.

In this regard, when using a line-type inkjet printer of a conventional configuration, usually, the viscosity of the ink needs to be sufficiently enhanced before the ink ejected to each position of the medium by one inkjet head reaches the position facing the next inkjet head to prevent inks of different colors from coming into contact in the liquid state, and the like. Therefore, for example, in the case of using the evaporation-drying type ink, a heater or the like needs to be provided between the inkjet heads with respect to the arrangement of the plurality of inkjet heads arranged side by side in the conveyance direction.

On the other hand, as described above, in the present example, the ultraviolet light source 104 collectively performs heating on the ink ejected to the medium 50 by the plurality of inkjet heads 202 in one ink ejection portion 102 on the downstream side of the ink ejection portion 102. Therefore, at first, it seems like inks of different colors come into contact in the liquid state on the medium 50 and smearing easily occurs. However, in the present example, the occurrence of such a problem is appropriately prevented by using a plurality of inkjet heads 202 that eject inks of a plurality of colors of a predetermined condition as the plurality of inkjet heads 202 in one ink ejection portion 102.

More specifically, in the present example, each inkjet head 202 in each ink ejection portion 102 ejects ink to an ejection position set according to the resolution of printing. Furthermore, when printing is performed by the inkjet method, for example, various colors are represented by forming ink dots of a plurality of colors at the same position on the medium 50. In this case, if only three colors of Y, M, and C are used as the inks of chromatic colors, for example, instead of using the seven-color separation system as in the present example, the inks of two or more colors need to be ejected in an overlapping manner to the same position on the medium 50 in all combinations for the inks of each color of Y, M, and C to represent various colors. In such a case, a heater or the like needs to be provided between the inkjet heads to appropriately prevent inks of different colors from coming into contact in a liquid state in the configuration of the line-type inkjet printer.

On the other hand, when printing is performed with the seven-color separation system as in the present example, as inks of R, G, and B, which are secondary colors combining two primary colors of Y, M, and C, exist, the ink of each color of Y, M, and C, in principle, does not need to be ejected to the same position on the medium 50. Furthermore, in this case, each color of the primary color is a color combining two colors of the secondary color. Therefore, in principle, the ink of each color of R, G, and B also does not need to be ejected to the same position on the medium 50. Further, in this case, the ink of K color which is the tertiary color can be considered as an ink which normally does not need to be ejected to the same position on the medium 50 as the inks of other colors.

Furthermore, as described above, in the present example, dark ink and pale ink are used for each color of B, G, R, and K. Then, in this case, the dark ink and the pale ink of the same color become, in principle, the ink having the possibility of being ejected to the same ejection position. On the other hand, in the present example, as described above, the ink ejection portion 102 including the inkjet head 202 that ejects the dark ink and the ink ejection portion 102 including the inkjet head 202 that ejects the pale ink are made different for the color using the dark ink and the pale ink.

Then, in this case, for the configuration of the present example, for example, it can be assumed that the inkjet head 202 of a combination of colors that does not need to be mixed on the medium 50 is selected as the plurality of inkjet heads 202 included in one ink ejection portion 102. Furthermore, it can also be assumed that, for example, the plurality of inkjet heads 202 in one ink ejection portion 102 eject ink so that ink dots of different colors do not overlap at the same ejection position. In this case, even if a heater or the like is not provided between the inkjet heads 202 in one ink ejection portion 102, the inks of a plurality of colors ejected on the medium 50 by a plurality of inkjet heads 202 can be appropriately dried while suppressing the occurrence of inter-color smearing, and the like by collectively performing heating with the ultraviolet light source 104 on the downstream side of the ink ejection portion 102 in the conveyance direction.

Furthermore, in this case, in each of the ink ejection portions 102, the plurality of inkjet heads 202 can be arranged at the packed intervals without widely spacing the inkjet heads 202 (distance between the heads). Moreover, for example, the number of heater required in the entire printing apparatus 10 can be significantly reduced as compared with a configuration in which heater or the like are always provided between the inkjet heads. Therefore, according to the present example, for example, the increase in size of the apparatus and the increase in cost can be appropriately suppressed even when using a large number of inkjet heads 202 such as with the seven-color separation system in the line system. In addition, high definition printing can be more appropriately performed. More specifically, in the present example, when printing is performed with the seven-color separation system in the line-type configuration, and the pale ink is further used, the increase in size of the apparatus and the increase in cost can be appropriately suppressed.

Furthermore, when collectively drying the inks of a plurality of colors ejected onto the medium 50 by the plurality of inkjet heads 202 in the line-type configuration, the amount of the ink existing in a liquid state on the medium 50 may be increased, and the like. However, when printing is performed through the seven-color separation system, for example, the amount of ink to be landed on the medium 50 can be significantly reduced as compared with the case where printing is performed using only four colors of Y, M, C, and K. Furthermore, as described above, in the present example, an instant-drying type ink capable of directly heating the ink by irradiating ultraviolet light is used as the ink. In this case, even when the amount of ink existing in a liquid state on the medium 50 is large, the ink can be efficiently heated in a short time.

Furthermore, the configuration of the ink ejection portion 102 is not limited to the above, and various changes can be made. For example, in each of the ink ejection portions 102, the order in which the plurality of inkjet heads 202 are arranged side by side (order of colors) is not limited to the order shown in FIGS. 2A and 2B, and may be variously changed. Furthermore, the number of head portions 12 to use, the inkjet head 202 for which color to install in the ink ejection portion 102 in each head portion 12, and the like in the printing apparatus 10 are not limited to the above, and various changes can be made.

Figure 2A:
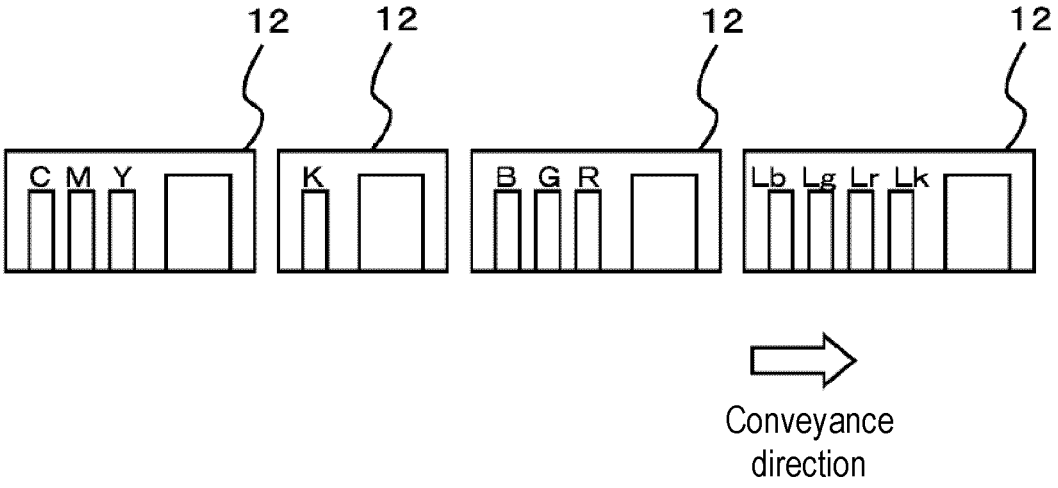
FIGS. 2A and 2B are views showing a modified example of the configuration of a plurality of head portions 12.
Figure 2B:
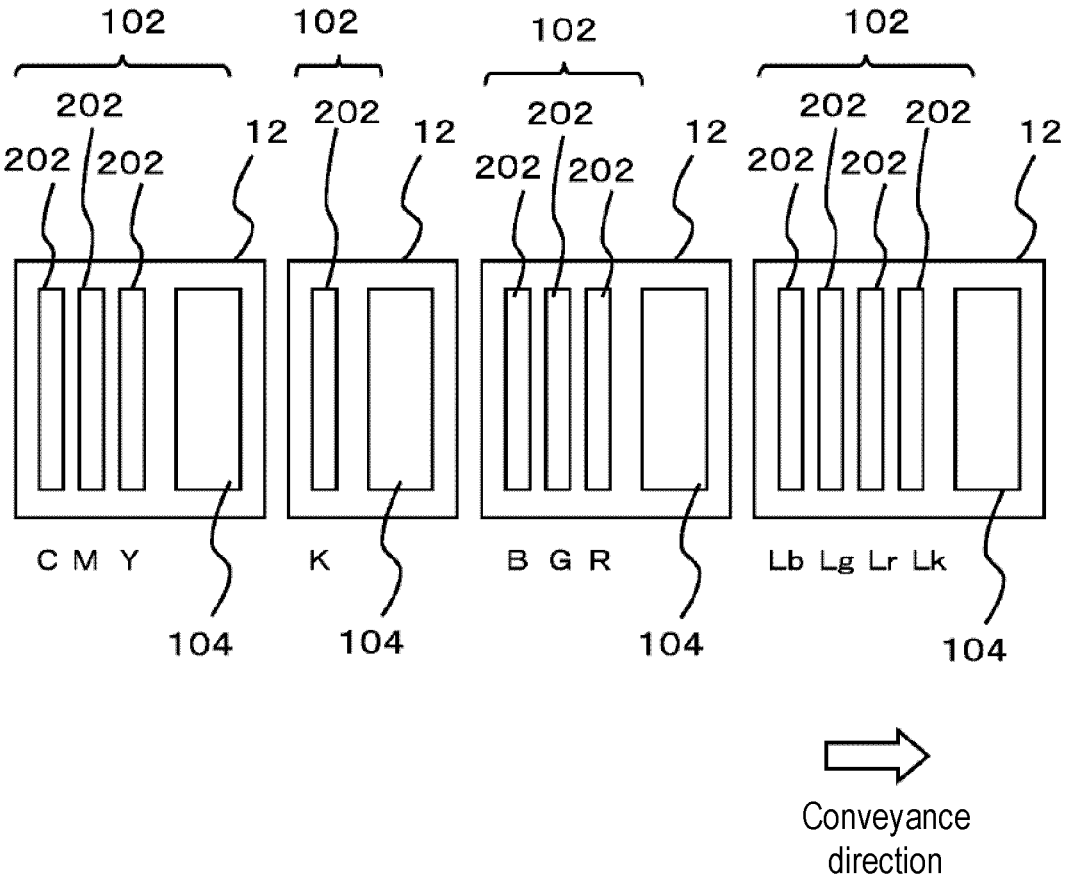

More specifically, in the configuration shown in FIGS. 2A and 2B, the ink ejection portions 102 in all the head portions 12 include a plurality of inkjet heads 202. However, in the modified example of the printing apparatus 10, for example, the ink ejection portion 102 including only one inkjet head 202 may be used as the ink ejection portion 102 of some of the head portions 12. In this case as well, the increase in size of the apparatus and the increase in cost can be appropriately suppressed when using a large number of inkjet heads 202 by using a configuration including a plurality of inkjet heads 202 as the ink ejection portion 102 of the other head portion 12.

Next, various modified examples will be described for the configuration of the plurality of head portions 12 included in the printing apparatus 10. FIGS. 2A and 2B are views showing a modified example of the configuration of the plurality of head portions 12, and shows an example of a configuration in a case where the ink ejection portion 102 including only one inkjet head 202 is used as the ink ejection portion 102 of some of the head portions 12. FIGS. 2A and 2B are a side view and a top view showing an example of the configuration of the plurality of head portions 12 in the present modified example, respectively.

Other than the points described below, in FIGS. 2A and 2B, the configuration denoted with the same reference numeral as FIGS. 1A and 1B may have a feature identical or similar to the configuration in FIGS. 1A and 1B. The plurality of head portions 12 shown in FIGS. 2A and 2B may be considered to be used, for example, in the printing apparatus 10 shown in FIGS. 1A and 1B instead of the plurality of head portions 12 in the configuration shown in FIGS. 1A and 1B. In this case, it is conceivable to appropriately change the operation or the like of each configuration of the printing apparatus 10 in accordance with the change in the configuration of the head portion 12.

As shown in the figure, in the present modified example, as the ink ejection portion 102 in each of the plurality of head portions 12, the ink ejection portion 102 including the inkjet head 202 for each color of C, M, and Y, the ink ejection portion 102 including the inkjet head 202 for K color, the ink ejection portion 102 including the inkjet head 202 for each color of B, G, and R, and the ink ejection portion 102 including the inkjet head 202 for the pale color (Lb, Lg, Lr, and Lk) of B, G, R, and K are used. In this case, the ink ejection portion 102 including the inkjet head 202 for the K color is an ink ejection portion 102 including only one inkjet head 202. Therefore, this configuration can be considered, for example, as a configuration in which the ink ejection portion 102 including only one inkjet head 202 is used as the ink ejection portion 102 of some of the head portions 12.

In the case of this configuration as well, when printing is performed with the seven-color separation system in the line-type configuration and the pale ink is further used, the increase in size of the apparatus and the increase in cost can be appropriately suppressed. Furthermore, in the present modified example, the inkjet head 202 for the ink for K color (dark ink for K color) is included in the ink ejection portion 102 different from the inkjet heads 202 for other colors, so that for example, the occurrence of inter-color smearing, and the like can be appropriately suppressed even when it becomes necessary to eject the K color ink and the ink of another color to the same position on the medium 50.

Figure 3A:
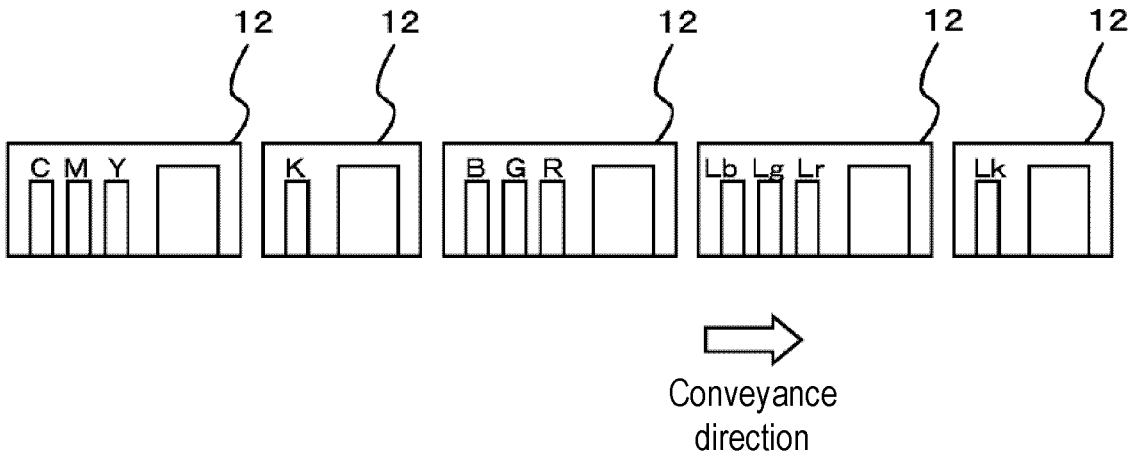
FIGS. 3A and 3B are views showing a further modified example of the configuration of the plurality of head portions 12.
Figure 3B:
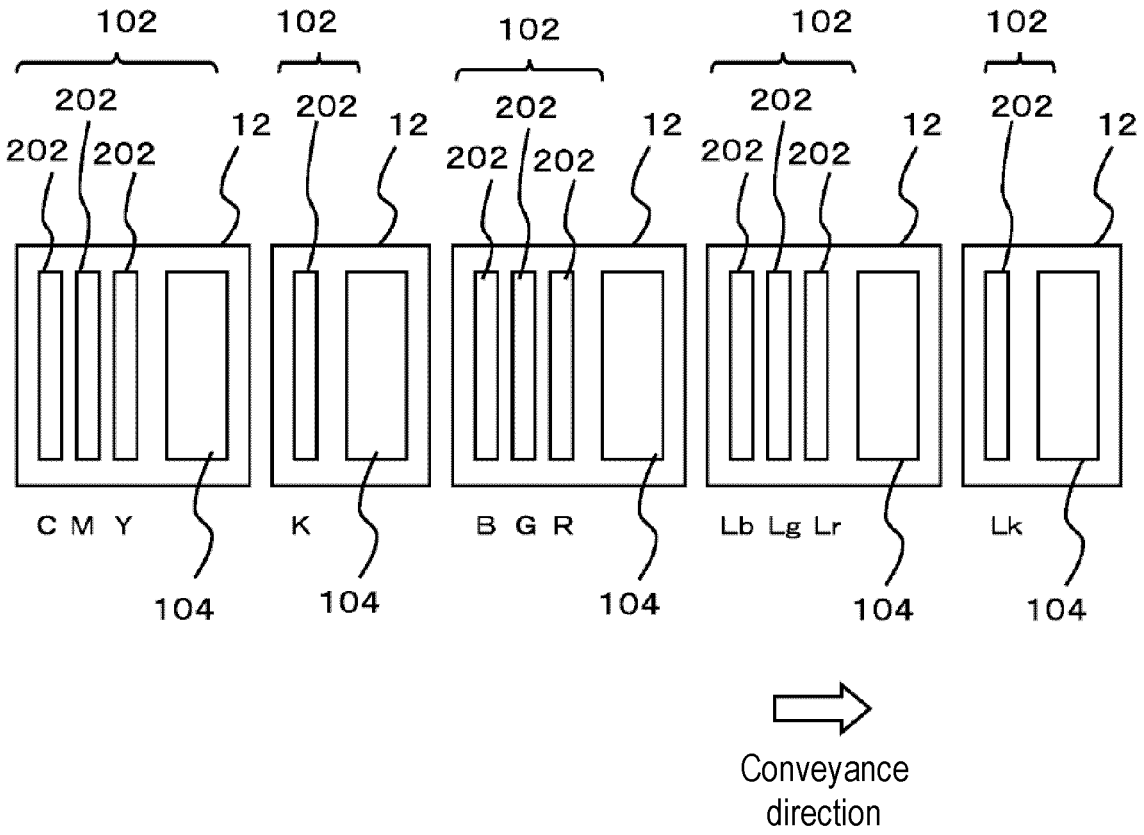

FIGS. 3A and 3B are views showing a further modified example of the configuration of the plurality of head portions 12, and shows another example of a configuration in a case where the ink ejection portion 102 including only one inkjet head 202 is used as the ink ejection portion 102 of some of the head portions 12. FIGS. 3A and 3B are a side view and a top view showing an example of the configuration of the plurality of head portions 12 in the present modified example, respectively.

Other than the points described below, in FIGS. 3A and 3B, the configuration denoted with the same reference numeral as FIGS. 1A and 1B or FIGS. 2A and 2B may have a feature identical or similar to the configuration in FIGS.

1A and 1B or FIGS. 2A and 2B. The plurality of head portions 12 shown in FIGS. 3A and 3B may be considered to be used, for example, in the printing apparatus 10 shown in FIGS. 1A and 1B instead of the plurality of head portions 12 in the configuration shown in FIGS. 1A and 1B. In this case, it is conceivable to appropriately change the operation or the like of each configuration of the printing apparatus 10 in accordance with the change in the configuration of the head portion 12.

As shown in the figure, in the present modified example, as the ink ejection portion 102 in each of the plurality of head portions 12, the ink ejection portion 102 including the inkjet head 202 for each color of C, M, and Y, the ink ejection portion 102 including the inkjet head 202 for K color, the ink ejection portion 102 including the inkjet head 202 for each color of B, G, and R, the ink ejection portion 102 including the inkjet head 202 for the pale color (Lb, Lg, and Lr) of B, G, and R, and the ink ejection portion 102 including the inkjet head 202 for the pale color (Lk) of K are used. Furthermore, in this case, the ink ejection portion 102 including the inkjet head 202 for K color and the ink ejection portion 102 including the inkjet head 202 for Lk color are an ink ejection portion 102 including only one inkjet head 202. Therefore, this configuration can also be considered, for example, as a configuration in which the ink ejection portion 102 including only one inkjet head 202 is used as the ink ejection portion 102 of some of the head portions 12.

In the case of this configuration as well, when printing is performed with the seven-color separation system in the line-type configuration and the pale ink is further used, the increase in size of the apparatus and the increase in cost can be appropriately suppressed. Furthermore, in the present modified example, the inkjet head 202 for the ink for K color and Lk (dark ink and pale ink for K color) is included in the ink ejection portion 102 different from the inkjet heads 202 for other colors, so that for example, the occurrence of inter-color smearing, and the like can be appropriately suppressed even when it becomes necessary to eject the ink of K color or Lk color and the ink of another color to the same position on the medium 50.

In a further modified example of the configuration of the plurality of head portions 12, for example, consideration is made to set the order of arrangement of the ink ejection portions 102 including the inkjet heads 202 for the ink of each color in consideration of the order in which the ink of each color lands on the medium 50. More specifically, for example, when printing in a line system is performed, the inks ejected later are assumed to have a greater influence on the graininess as ink dots of respective colors overlap in order. Therefore, in this case, the ink of a color that makes the graininess more noticeable is preferably ejected to the medium before the ink of other colors.

Figure 4A:
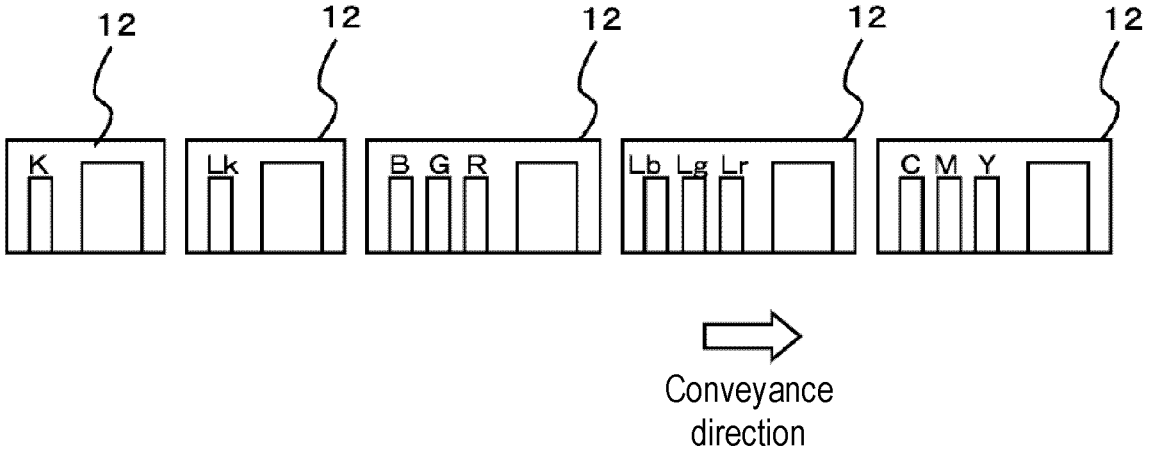
FIGS. 4A and 4B are views showing a modified example of the configuration of the plurality of head portions 12 when the order in which the ink of each color lands on a medium 50 is taken into consideration.
Figure 4B:
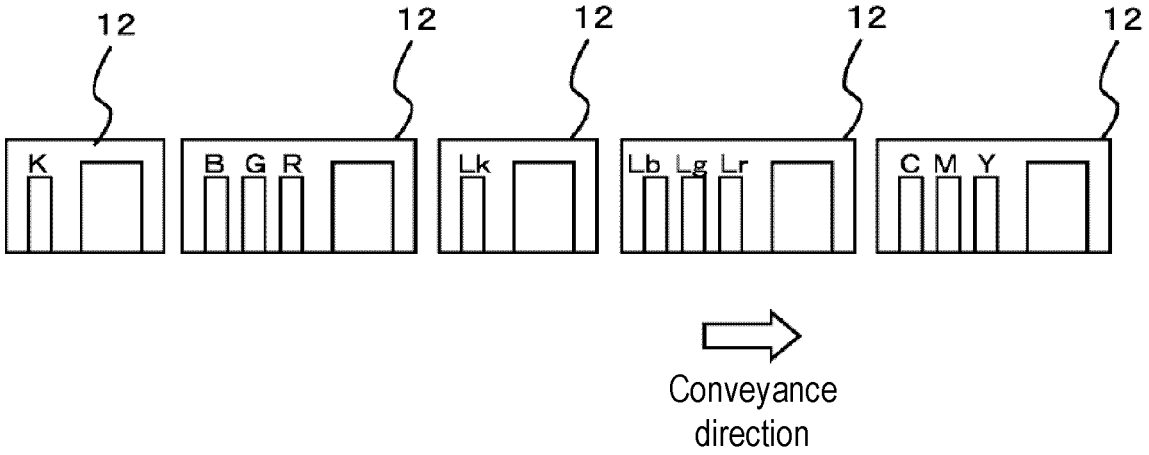

FIGS. 4A and 4B are views showing a modified example of the configuration of the plurality of head portions 12 in the case where the order in which the ink of each color lands on the medium 50 is taken into consideration. FIGS. 4A and 4B are side views respectively showing the configuration of such a modified example.

Other than the points described below, in FIGS. 4A and 4B, the configuration denoted with the same reference numeral as FIGS. 1A to 3B may have a feature identical or similar to the configuration in FIGS. 1A to 3B. It is conceivable to use the plurality of head portions 12 shown in FIGS. 4A and 4B, for example, in the printing apparatus 10 shown in FIGS. 1A and 1B instead of the plurality of head portions 12 in the configuration shown in FIGS. 1A and 1B. In this case, it is conceivable to appropriately change the operation or the like of each configuration of the printing apparatus 10 in accordance with the change in the configuration of the head portion 12.

In the case of representing various colors through the subtractive color mixing method using inks of primary colors such as each color of Y, M, and C, when inks of secondary colors are further used, the graininess is usually more noticeable in the inks of secondary colors than in the inks of primary colors. Therefore, when the ink ejection portion 102 (ink ejection portion 102 for primary color) including the inkjet head 202 for each color of the primary color and the ink ejection portion 102 (ink ejection portion 102 for secondary color) including the inkjet head 202 for each color of the secondary color are used, the ink ejection portion 102 for the secondary color is preferably disposed on the upstream side of the ink ejection portion 102 of the primary color in the conveyance direction so that the ink of the secondary color in which the graininess is more noticeable lands on the medium 50 before the ink of the primary color.

Furthermore, in the case in which the ink of K color (dark ink of K color) that is a tertiary color is used, the influence on the graininess, in particular, is usually large for the ink of K color. Therefore, in this case, the ink ejection portion 102 including the inkjet head 202 for the K color (ink ejection portion 102 for K color) is preferably disposed at least at a position other than the most downstream in the conveyance direction. In this case, disposing the ink ejection portion 102 for the K color at a position other than the most downstream in the conveyance direction means, for example, disposing the ink ejection portion 102 on the upstream side of any other ink ejection portions 102 in the conveyance direction. Furthermore, in this case, the ink ejection portion 102 including the inkjet head 202 for the Lk color, which is a pale ink of K color, is preferably disposed at a position other than the most downstream in the conveyance direction. In addition, when the dark ink and the pale ink of the same color are compared for the color using the dark ink and the pale ink, the dark ink has a greater influence on the graininess. Therefore, the ink ejection portion 102 including the inkjet head 202 that ejects the dark ink of each color is preferably disposed on the upstream side than the ink ejection portion 102 including the inkjet head 202 that ejects the pale ink of the same color in the conveyance direction. With the above configuration, for example, the graininess can be more appropriately prevented from being noticeable in the printing result. Furthermore, in this case, it is conceivable to use the configurations shown in FIGS. 4A and 4B, for example, as specific configurations of the head portion 12 and the ink ejection portion 102.

Furthermore, the configuration described above, for example, can be considered as a configuration in which the ink ejection portion 102 for ink of dark color is disposed on the upstream side in the conveyance direction and the ink ejection portion 102 for ink of light color is disposed on the downstream side in the conveyance direction with the ink ejection portion 102 as a unit. In this case, in order to more appropriately suppress the graininess, in each of the ink ejection portions 102 as well, the plurality of inkjet heads 202 included in the ink ejection portion 102 are preferably disposed so that the inkjet head 202 for a dark color in which the graininess is easily noticeable is on the more upstream side in the conveyance direction.

Furthermore, in order to more appropriately suppress the graininess, for example, as shown in common in FIGS. 4A and 4B, for the arrangement of the inkjet heads 202 for the dark ink of primary color, secondary color and tertiary color, the inkjet heads 202 for the tertiary color are preferably disposed on the upstream side of the inkjet heads 202 for the primary color and the secondary color in the conveyance direction and the inkjet heads 202 for the secondary color are preferably disposed on the upstream side of the inkjet head 202 for the primary color in the conveyance direction. In this case, the inkjet heads 202 for pale colors of the respective colors may be disposed at various positions according to the quality required for printing, and the like. More specifically, for example, consideration is made to dispose the inkjet head 202 for the pale ink of the tertiary color (Lk color), on the upstream side of the inkjet head 202 for the pale ink of the secondary color in the conveyance direction to dispose it on the upstream side of the inkjet head 202 for the dark ink of the secondary color as shown in FIG. 4A, and dispose it on the downstream side of the inkjet head 202 for the dark ink of the secondary color in the conveyance direction as shown in FIG. 4B. Although not shown, it is conceivable to dispose the inkjet heads 202 for the pale ink of the secondary color and the pale ink of the tertiary color, for example, on the downstream side of the inkjet head 202 for the dark color of the primary color in the conveyance direction. In addition, as a further modified example of the configuration of the plurality of head portions 12, consideration is made to use a pale ink (e.g., ink of Lc color and Lm color) for at least some of the primary colors (e.g., C color and M color). In this case, it is conceivable to dispose the inkjet head 202 for the pale ink for the primary color on the downstream side of the other colored inkjet heads 202 in the conveyance direction.

Next, supplementary description and the like will be made regarding each configuration described above. As also described above, when printing is performed through the seven-color separation system, for example, the amount of ink to be landed on the medium 50 can be significantly reduced compared to when printing is performed using only four colors of Y, M, C, and K. Furthermore, for example, a plurality of inkjet heads 202 for different colors can be combined so that they do not have to be ejected to the same position on the medium 50. Then, in each configuration described above, using such property, the increase in size of the apparatus and the increase in cost can be appropriately suppressed when a large number of inkjet heads 202 are used in the line system configuration. Hereinafter, the relationship between the arrangement of the inkjet head and the color of the ink to use will be described in more detail.

Figure 5:
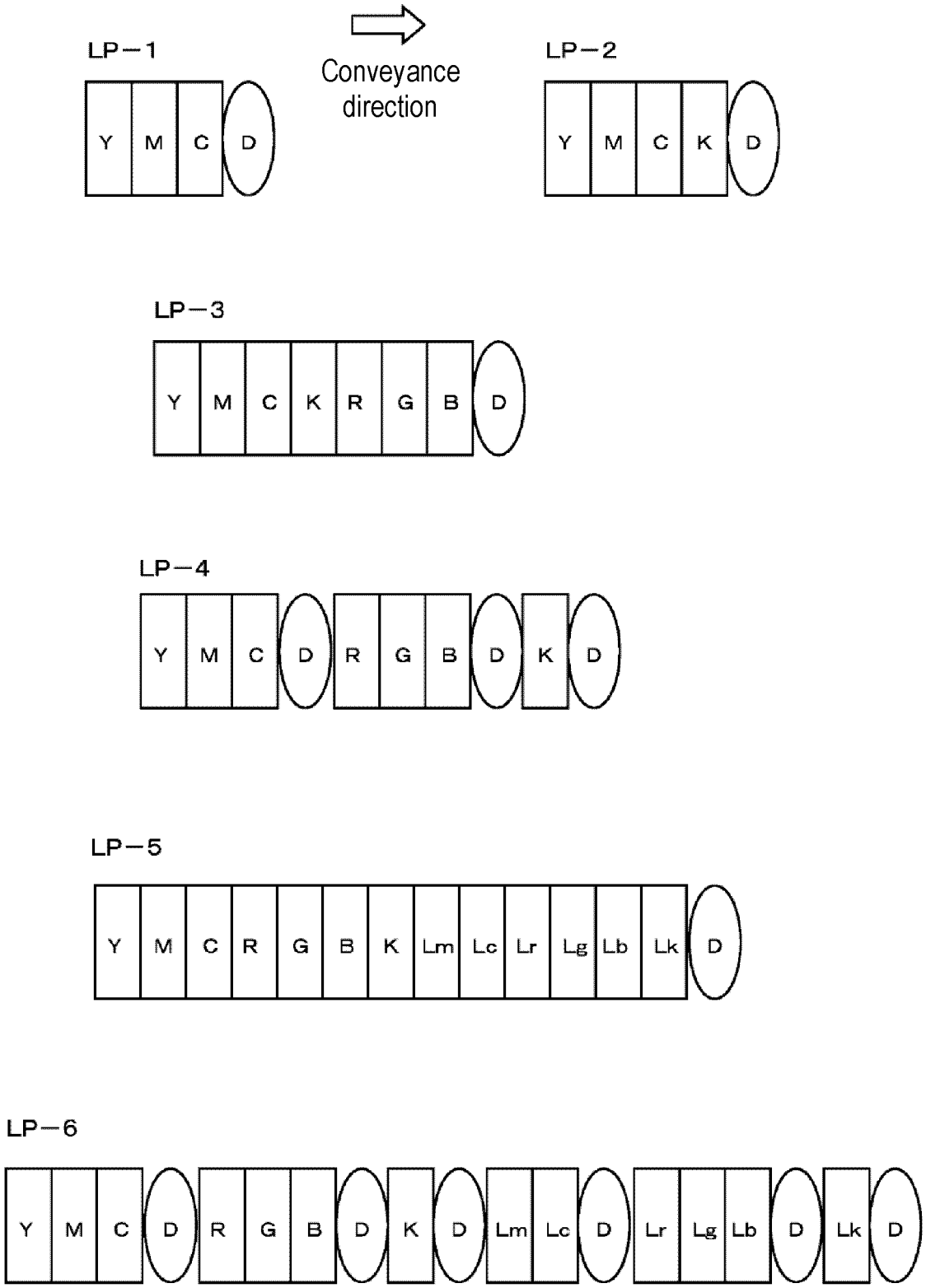
FIG. 5 is a view describing the arrangement of inkjet heads in a line system.

FIG. 5 is a view describing the arrangement of the inkjet heads in the line system, and as indicated as LP-1 to LP-6 in the figure, shows an example of the arrangement of the various inkjet heads in the line system including the reference example other than the configuration corresponding to the present disclosure. Furthermore, in each configuration indicated as LP-1 to LP-6, a rectangle shown together with a character indicating a color indicates one inkjet head that ejects an ink of the color indicated by the character. In addition, an ellipse shown with a character D indicates a dryer for drying the ink. As the dryer, for example, it is conceivable to use an ultraviolet light source or the like for heating an instant-drying type ink. More specifically, among the configurations shown as LP-1 to LP-6 in the figure (hereinafter referred to as configurations of LP-1 to LP-6 etc.), the configurations of LP-1 to LP-4 are examples of configurations for a case where the pale ink is not used. Furthermore, the configurations of LP-5 to LP-6 are examples of configurations for a case where the pale ink is used.

Furthermore, among the respective configurations, the configuration of LP-1 shows an example of the arrangement of an inkjet head and an ultraviolet light source in a three-color separation system in which printing is performed using only the ink of each color of Y, M, and C which is a primary color. In the configuration of LP-1, the inkjet heads for three colors of Y, M, and C are arranged side by side in the conveyance direction of the medium, and one ultraviolet light source is disposed on the downstream side thereof. Furthermore, the configuration of LP-2 shows an example of the arrangement of an inkjet head and an ultraviolet light source in a four-color separation system in which printing is performed using K color which is a tertiary color in addition to the ink of each color of Y, M, and C which is a primary color. In the configuration of the LP-2, the inkjet heads for four colors of Y, M, C, and K are arranged side by side in the conveyance direction of the medium, and one ultraviolet light source is disposed on the downstream side thereof.

Furthermore, the configurations of LP-3 and LP-4 show an example of the arrangement of an inkjet head and an ultraviolet light source in a seven-color separation system in which printing is performed using each color of Y, M, and C which is a primary color, each color of R, G, and B which is a secondary color, and K color which is a tertiary color. Moreover, among the configurations, the configuration of LP-3 is a configuration in which inkjet heads for all colors are arranged side by side in the conveyance direction of the medium, and only one ultraviolet light source is disposed on the downstream side thereof. In addition, the configuration of LP-4 is a configuration in which the inkjet heads are arranged side by side while being divided for every order of colors, and an ultraviolet light source is disposed with respect to the inkjet head of each order, from the standpoint similar to each configuration described above using FIGS. 1A to 4B.

The configurations of LP-5 to LP-6 show examples of the arrangement of the inkjet head and the ultraviolet light source in the case of further using ink of pale color in the seven-color separation system. Furthermore, as the ink of pale color, as shown in the figure, the ink of each color of Lm, Lc, Lr, Lg, Lb and Lk which are pale colors of each color of M, C, R, G, B, and K (each color other than Y color) are used. Moreover, among the configurations, the configuration of LP-5 is a configuration in which inkjet heads for all colors are arranged side by side in the conveyance direction of the medium, and only one ultraviolet light source is disposed on the downstream side thereof. In addition, the configuration of LP-6 is a configuration in which the inkjet heads are arranged side by side while being divided for every order of colors and every color strength of the ink (dark ink and pale ink), and an ultraviolet light source is disposed with respect to the arrangement of each ink, from the standpoint similar to each configuration described above using FIGS. 1A to 4B.

In addition, considering the arrangement of the inkjet head and the ultraviolet light source in the various configurations described above, the total amount of ink existing in the undried state on the medium (total undried landing ink amount at the time of print) differs according to the configuration, even under the condition of printing the same color at the time of printing. In this case, the amount of ink existing in the undried state on the medium means the amount of ink ejected per unit area by the plurality of inkjet heads in the previous stage until the ultraviolet light is irradiated by the ultraviolet light source.

Figure 6:
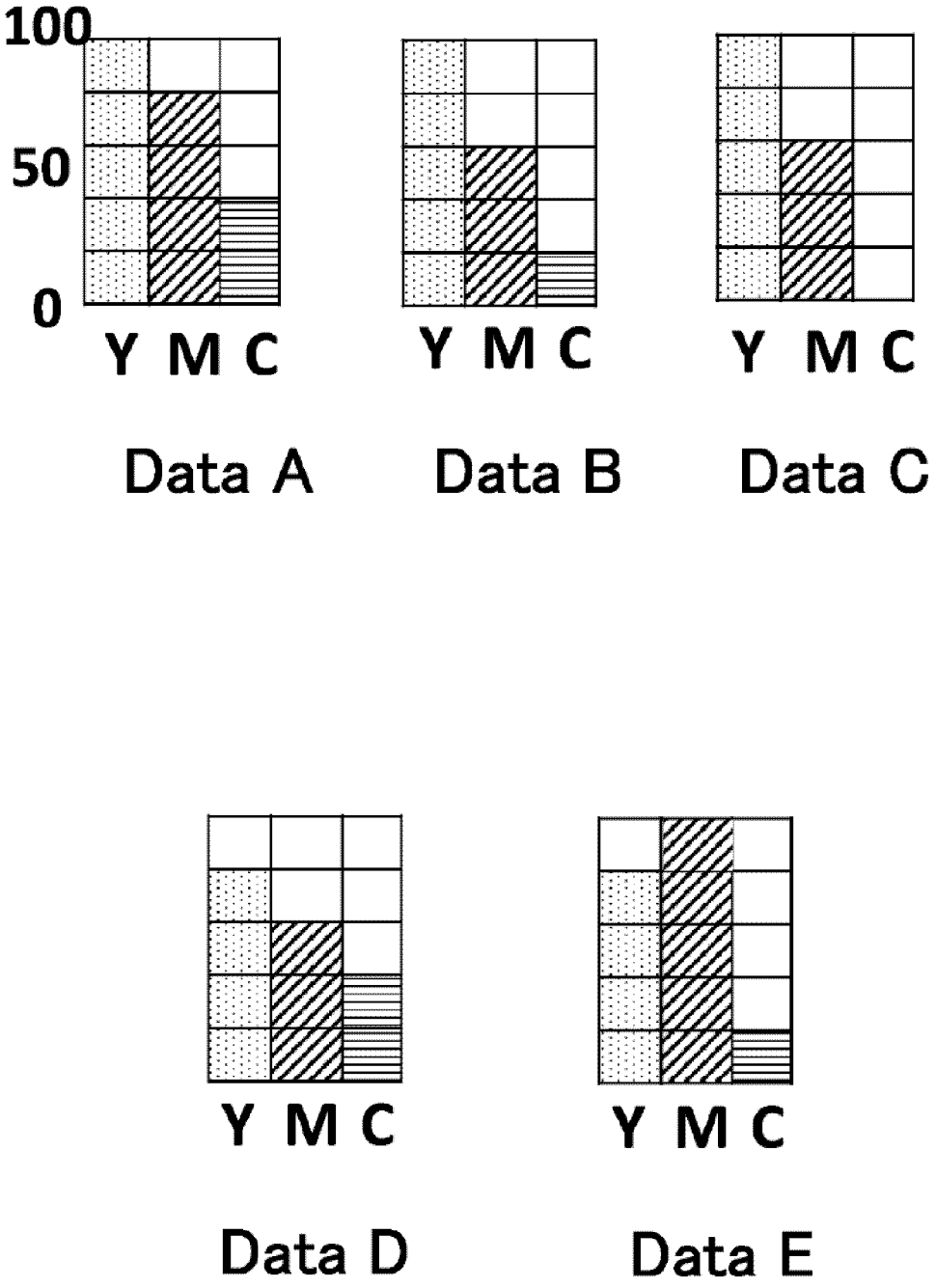
FIG. 6 is a view showing an example of the ratio of ejection amounts of ink of each color in the case of representing various colors using only inks of three colors of Y, M, and C.

FIG. 6 shows an example of the ratio of the ejection amount of ink of each color for a case where various colors are represented using only inks of three colors of Y, M, and C. More specifically, FIG. 6 shows an example of the proportion of each color ejected with respect to the unit area for the colors corresponding to the five types of data shown as Data A to E. In this case, for each of Data A to E, for example, data indicating the ratio combining the inks of each color of Y, M, C and the like can be considered. In this case, the proportion shown as 100 in the figure is a proportion corresponding to the concentration of 100%. Furthermore, the concentration of 100% refers to the proportion when ink is ejected to all ejection positions set according to the resolution. As shown in the figure, various colors can be represented by changing the ejection amounts of the inks of each color of Y, M, and C at various ratios.

FIG. 7 is a view showing an example of a relationship between the arrangement of the inkjet head and the color of the ink, and shows an example of the amount of ink existing in the undried state on the medium in the case where the color corresponding to each of Data A to E is represented by each configuration of LP-1 to LP-6. In this case, the color corresponding to each of Data A to E is the same color as the color indicated by Data A to E in the case of the three-color separation system. More specifically, in FIG. 7, in the case where the color strength of the pale ink is set to a half of the color strength of the dark ink, it indicates the maximum value of the sum of the amount of ink to exist in the undried state on the medium when filling with the color corresponding to each of Data A to E in the printing in a line system (1 pass print) by each configuration of LP1-LP-6. In this case, the sum of the amount of ink to exist in the undried state is the total amount of ink existing in the liquid state on the medium immediately before the timing of irradiating the ultraviolet light with the respective ultraviolet light sources in each configuration.

Furthermore, in FIG. 7, the usage amount of ink of each color used when representing the same color as the color indicated by Data A to E is shown for the ink of each color used in a three-color separation system, a four-color separation system, a seven-color separation system (without pale color), and a seven-color separation system (with pale color) each corresponding to LP-1 to LP-6. In this case, the usage amount of ink indicates, as in the case described above with reference to FIG. 6, the proportion indicating the case where ink is ejected to all ejection positions set according to the resolution as 100%.

As shown in the figure, the amount of ink that exists in the undried state on the medium (hereinafter simply referred to as the total amount of ink) can be reduced by using the seven-color separation system. Furthermore, in this case, the total amount of ink can be significantly reduced by using the configuration of LP-4, for example, as compared with the configuration of LP-3 in which the types of ink to use are the same. However, as can be seen from, for example, the results corresponding to the configuration of LP-5, when using the seven-color separation system, the total amount of ink significantly increases if the pale ink is simply added. In this case, the problem of smearing is assumed to easily occur. On the other hand, if, for example, the configuration of LP-6 is used, an increase in the total amount of ink can be appropriately suppressed even when the pale ink is used. More specifically, in this case, the total amount of ink can be 100% or less. Furthermore, this, for example, appropriately suppresses the occurrence of inter-color smearing and the like. Moreover, from these results, it can be understood that printing in the seven-color separation system using a pale ink can be appropriately performed by each configuration described using FIGS. 1A to 4B and the like.

Subsequently, further supplementary description, description of modified examples, and the like will be made regarding each configuration of the printing apparatus 10. Each configuration described above, for example, can be considered as a configuration in which the ultraviolet light source 104, which is an instant-dryer, is disposed by being divided into at least primary color and secondary color, and also divided into dark ink and pale ink of the same color. Furthermore, regarding each configuration described above, for example, a combination of colors of ink ejected by the inkjet head 202 of one ink ejection portion 102 can be considered as a group in which drying of ink is performed by the same ultraviolet light source 104. In this case, the tertiary color may be included in the same group as the primary color or the secondary color, or may be included in a group different from the primary color and the secondary color. In addition to the above, various modifications can be considered for the arrangement of the ink ejection portion 102 and the inkjet head 202. For example, depending on the required printing quality and the like, with respect to the configuration shown in FIGS. 2A and 2B, the head portion 12 configured by the ink ejection portion 102 including the inkjet head 202 for K color and the ultraviolet light source 104 can be disposed on the most downstream in the conveyance direction. Further, for example, when pale inks (e.g., inks of Lc and Lm colors) of primary colors (e.g., C and M colors) are used, it is conceivable to dispose the ink ejection portion 102 including the inkjet heads 202 for the Lc and Lm colors separate from the ink ejection portion 102 including the inkjet head 202 for pale ink for the secondary color. In this case, for example, the inkjet head 202 for Lk color which is the pale color of the tertiary color may be included in the same ink ejection portion 102 as the inkjet head 202 for the primary color. In this case, for example, with respect to the configuration shown in FIGS. 1A and 1B, it is conceivable to add a new head portion 12 at a position to become the head portion 12 third from the upstream side in the conveyance direction. Furthermore, it is conceivable to use the ink ejection portion 102 including the inkjet heads 202 for Lm color, Lc color, and Lk color as the ink ejection portion 102 in the newly added head portion 12. In this case, for the head portion 12 located third from the upstream side in the conveyance direction in FIGS. 1A and 1B, for example, the inkjet head 202 for Lk color is removed from the ink ejection portion 102 in the head portion 12, and then used as the head portion 12 fourth from the upstream side in the conveyance direction.

Moreover, in the description made above, the case where the instant-drying type ink is mainly used as ink of each color has been described. However, it is conceivable to use an ink other than the instant-drying type as the ink of each color. In this case, for example, it is conceivable to use an evaporation drying type ink other than the instant-drying type. Furthermore, in this case, it is conceivable to use various heaters or the like in place of the ultraviolet light source 104 in each of the head portions 12. In this case, the heater is, for example, a heater that heats the ink together with the medium by heating the medium.

In addition, it is also conceivable to use an ink other than the evaporation drying type as the ink. In this case, for example, it is conceivable to use an ultraviolet-curable ink or the like that is cured by irradiation of ultraviolet light. The ultraviolet-curable ink is, for example, an ink which contains a polymerizable substance such as a monomer or an oligomer and is cured by a polymerization reaction caused by irradiation of ultraviolet light. Furthermore, in this case, it is conceivable to use the ultraviolet light sources 104 in the respective head portions 12 as ultraviolet light sources for curing the ink.

Furthermore, in the above description, the case where printing is performed through the complete seven-color separation system using seven colors of Y, M, C, K, R, G, and B has been mainly described. However, depending on the quality required for printing, not all the R, G, and B colors are used as the inks of secondary colors, and it is conceivable to use only some of the R, G, and B colors (e.g., only R and G colors, etc.). It is also conceivable to use, for example, ink of an orange color (OR color) or the like instead of the ink of R color. Furthermore, with regard to the color of the ink to use for printing, depending on the quality and the like required for printing, it is conceivable to use only the dark ink without using the ink of pale color.

INDUSTRIAL APPLICABILITY

The present disclosure can be suitably used in, for example, a printing apparatus.

What is claimed is:

1. A printing apparatus that performs a printing through an inkjet method, the printing apparatus comprising:

a medium conveyor device that conveys a medium to be printed in a conveyance direction set in advance;

a plurality of ink ejection portions, arranged side by side along the conveyance direction;

a plurality of fixing devices that fix inks to the medium; and a controller configured to control ejection of the inks from the plurality of ink ejection portions, wherein each of the ink ejection portions includes: a plurality of inkjet heads that eject inks of different colors, the plurality of inkjet heads in each of the ink ejection portions are arranged side by side along the conveyance direction, and wherein the plurality of ink ejection portions include at least:

a first ink ejection portion including the plurality of inkjet heads, each of which ejecting ink of a primary color, which is a basic color that in principle allows representation of colors in a subtractive color mixing method by color mixing; and a second ink ejection portion including the plurality of inkjet heads, each of which ejecting ink of a secondary color obtained in principle by mixing a plurality of the primary colors, at least one of the plurality of fixing devices is disposed on a downstream side in the conveyance direction with respect to the first ink ejection portion, and after the medium passes a position facing the plurality of inkjet heads in the first ink ejection portion, the inks ejected by the first ink ejection portion are fixed to the medium, wherein the controller is configured to control ejection of the inks in a way that:

the inks of the primary color different from each other are not ejected to the same position among the inks ejected from the first ink ejection portion, and the inks of the secondary color are ejected from the second ink ejection portion to an ejection position where a color mixing of the primary color is required.

2. The printing apparatus according to claim 1, wherein each of the inkjet heads in each of the ink ejection portions ejects the inks to the ejection position set according to a resolution of printing, and the plurality of inkjet heads in one of the ink ejection portions eject the inks such that ink dots of different colors do not overlap at the same ejection position.

3. The printing apparatus according to claim 1, wherein each of the plurality of inkjet heads of the first ink ejection portion ejects ink of each color of yellow, magenta, and cyan; and each of the plurality of inkjet heads of the second ink ejection portion ejects ink of each color of red, green, and blue.

4. The printing apparatus according to claim 1, wherein the second ink ejection portion is disposed on an upstream side of the first ink ejection portion in the conveyance direction.

5. The printing apparatus according to claim 1, wherein among the plurality of ink ejection portions, any one of the ink ejection portions includes an inkjet head that ejects black color ink, and the ink ejection portion including the inkjet head that ejects the black color ink is disposed on an upstream side of any other ink ejection portions in the conveyance direction.

6. The printing apparatus according to claim 1, wherein a dark ink in which a color strength is relatively dark and a pale ink in which a color strength is relatively light are used as inks of at least any one of the colors, and for a color using the dark ink and the pale ink, the ink ejection portion including the inkjet head that ejects the dark ink is different from the ink ejection portion including the inkjet head that ejects the pale ink.

7. The printing apparatus according to claim 6, wherein the ink ejection portion including the inkjet head that ejects the dark ink is disposed on an upstream side of the ink ejection portion including the inkjet head that ejects the pale ink of the same color in the conveyance direction.

8. A printing apparatus that performs a printing through an inkjet method, the printing apparatus comprising:

a medium conveyor device that conveys a medium to be printed in a conveyance direction set in advance;

a plurality of ink ejection portions, arranged side by side along the conveyance direction; and a plurality of fixing devices that fix an ink to the medium;

wherein each of the ink ejection portions includes: a plurality of inkjet heads that eject inks of different colors, the plurality of inkjet heads in each of the ink ejection portions are arranged side by side along the conveyance direction, and each of the plurality of fixing devices is disposed on a downstream side in the conveyance direction with respect to any one of the ink ejection portions, and after the medium passes a position facing the plurality of inkjet heads in one of the ink ejection portions, the ink ejected by the one of the ink ejection portions is fixed to the medium, the ink ejected by each of the inkjet heads in each of the ink ejection portions is an ink that fixes to the medium by evaporation of a solvent and that generates heat by absorbing an energy ray which is predetermined, and each of the plurality of fixing devices heats the ink on the medium by irradiating the ink on the medium with the energy ray, wherein the energy ray is ultraviolet light, the ink contains an ultraviolet absorbing agent as a substance that absorbs the energy ray and generates heat.

9. The printing apparatus according to claim 8, wherein each of the inkjet heads in each of the ink ejection portions ejects the ink to an ejection position set according to a resolution of printing, and the plurality of inkjet heads in one of the ink ejection portions eject the ink such that ink dots of different colors do not overlap at the same ejection position.

10. The printing apparatus according to claim 8, wherein the plurality of ink ejection portions include at least:

a first ink ejection portion including the plurality of inkjet heads, each of which ejecting ink of a primary color, which is a basic color that in principle allows representation of colors in a subtractive color mixing method by color mixing; and a second ink ejection portion including the plurality of inkjet heads, each of which ejecting ink of a secondary color obtained in principle by mixing a plurality of the primary colors.

11. The printing apparatus according to claim 8, wherein the plurality of ink ejection portions include at least:

a first ink ejection portion including the plurality of inkjet heads, each of which ejecting ink of each color of yellow, magenta, and cyan; and a second ink ejection portion including the plurality of inkjet heads, each of which ejecting ink of each color of red, green, and blue.

12. The printing apparatus according to claim 8, wherein among the plurality of ink ejection portions, any one of the ink ejection portions includes an inkjet head that ejects black color ink, and the ink ejection portion including the inkjet head that ejects the black color ink is disposed on an upstream side of any other ink ejection portions in the conveyance direction.

13. The printing apparatus according to claim 8, wherein a dark ink in which a color strength is relatively dark and a pale ink in which a color strength is relatively light are used as ink of at least any one of the colors, and for a color using the dark ink and the pale ink, the ink ejection portion including the inkjet head that ejects the dark ink is different from the ink ejection portion including the inkjet head that ejects the pale ink.

14. A print method that performs a printing through an inkjet method, the print method comprising:

ejecting an ink to a medium from a plurality of ink ejection portions arranged side by side along a conveyance direction set in advance, while conveying the medium to be printed in the conveyance direction; and fixing the ink to the medium by a plurality of fixing devices, wherein each of the ink ejection portions includes: a plurality of inkjet heads that eject inks of different colors, the plurality of inkjet heads in each of the ink ejection portions are arranged side by side along the conveyance direction, and each of the plurality of fixing devices is disposed on a downstream side in the conveyance direction with respect to any one of the ink ejection portions, and after the medium passes a position facing the plurality of inkjet heads in one of the ink ejection portions, the ink ejected by the one of the ink ejection portions is fixed to the medium, wherein an ink of a primary color which is a basic color that in principle allows representation of colors in a subtractive color mixing method by color mixing, and an ink of a secondary color obtained in principle by mixing a plurality of the primary color are respectively ejected as the ink, wherein the ink of the primary color are ejected to an ejection position where a color mixing of the primary color is required, so that the inks of the primary color different from each other are not ejected to the same position, and after the ink of the primary color is fixed to the medium by the fixing devices, the inks of the secondary color are ejected to the ejection position where the color mixing of the primary color is required.

* * * * *